US006510577B1

(12) United States Patent
Borcherds et al.

(10) Patent No.: US 6,510,577 B1
(45) Date of Patent: Jan. 28, 2003

(54) MESH SPONGE WITH LOOFAH

(75) Inventors: Victor Borcherds, Thermal, CA (US); Suzanne Borcherds, Thermal, CA (US); Manfredo Nolasco, Sansalvador (SV)

(73) Assignee: Jean Charles Incorporated, Thermal, CA (US)

( * ) Notice: Subject to any disclaimer, the term of this patent is extended or adjusted under 35 U.S.C. 154(b) by 335 days.

(21) Appl. No.: 09/586,143

(22) Filed: Jun. 2, 2000

Related U.S. Application Data

(63) Continuation-in-part of application No. 29/108,962, filed on Aug. 6, 1999.

(60) Provisional application No. 60/137,660, filed on Jun. 4, 1999.

(51) Int. Cl.[7] ..... E04F 21/16

(52) U.S. Cl. ..... 15/118; 15/209.1; 15/210.1; 15/229.11; 15/229.13; 601/138

(58) Field of Search ..... 15/118, 209.1, 15/210.1, 229.11, 229.14, 229.13; 601/138; D32/40; D28/63

(56) References Cited

U.S. PATENT DOCUMENTS

| | | | | | |
|---|---|---|---|---|---|
| 455,567 | A | * | 7/1891 | Kraft | 15/118 |
| 720,890 | A | * | 2/1903 | Campbell et al. | 15/209.1 |
| 2,581,779 | A | | 1/1952 | Abraham | |
| 2,585,781 | A | | 1/1952 | Johnson | |
| 2,666,249 | A | | 1/1954 | Ruiz et al. | |
| 2,849,821 | A | | 9/1958 | Doig | |
| 3,038,187 | A | | 6/1962 | Nathanson | |
| 3,146,479 | A | | 9/1964 | Stoker | |
| 3,281,884 | A | | 11/1966 | Feil | |
| 3,336,618 | A | | 8/1967 | Day | |
| 3,345,668 | A | | 10/1967 | Forrest | |
| 3,816,888 | A | | 6/1974 | Rather, Jr. | |
| 3,922,407 | A | | 11/1975 | Nimmo, Jr. et al. | |
| 4,034,443 | A | | 7/1977 | Turner | |
| 4,112,551 | A | | 9/1978 | Sales | |
| 4,199,835 | A | | 4/1980 | Heyer et al. | |
| 4,254,530 | A | * | 3/1981 | Lambert | 112/475.08 |
| 4,454,968 | A | | 6/1984 | StLawrence | |
| 4,462,135 | A | | 7/1984 | Stanford | |
| 4,585,676 | A | | 4/1986 | DeSmet et al. | |
| 4,636,208 | A | * | 1/1987 | Rath | 15/210.1 |
| 4,714,182 | A | | 12/1987 | Hecht | |
| 4,840,822 | A | | 6/1989 | Cheng | |
| 4,919,980 | A | | 4/1990 | Pirkey | |
| 5,144,744 | A | | 9/1992 | Campagnoli | |
| 5,187,830 | A | * | 2/1993 | Giallourakis | 15/209.1 |
| 5,295,280 | A | | 3/1994 | Hudson et al. | |
| 5,356,056 | A | | 10/1994 | Teuten | |
| 5,411,188 | A | | 5/1995 | Teuten | |
| 5,650,384 | A | | 7/1997 | Gordon et al. | |
| 5,687,447 | A | | 11/1997 | Bynum et al. | |
| 5,709,434 | A | | 1/1998 | Chen | |
| 5,740,599 | A | | 4/1998 | Chang | |
| 5,758,386 | A | | 6/1998 | Chen | |

(List continued on next page.)

FOREIGN PATENT DOCUMENTS

| | | | | | |
|---|---|---|---|---|---|
| CH | 000148056 | B | * | 9/1931 | 15/229.1 |

OTHER PUBLICATIONS

"The American Heritage Dictionary of the English Language, Fourth Edition", 2000 Houghton Mifflin Company.*

*Primary Examiner*—Robert J. Warden, Sr.
*Assistant Examiner*—Laura C Cole
(74) *Attorney, Agent, or Firm*—Workman, Nydegger & Seeley

(57) ABSTRACT

Sponge assemblies include a substantially spherical mesh sponge having an element of loofah secured thereto. In one embodiment, the element of loofah includes a substantially flat disk including an outer layer of loofah, an inner layer of loofah, and a reinforcing layer disposed therebetween. In another embodiment, the element of loofah includes a block of uncompressed natural loofah.

11 Claims, 13 Drawing Sheets

U.S. PATENT DOCUMENTS 5,766,700 A 6/1998 Borcherds
5,784,747 A 7/1998 Girardot et al.
5,904,409 A 5/1999 Girardot et al.
5,937,472 A 8/1999 Girardot et al.
5,946,780 A 9/1999 Borcherds et al.
5,970,566 A 10/1999 Girardot et al.
6,131,234 A 10/2000 Chen
6,161,246 A * 12/2000 Trachtenberg ..... 15/209.1
D452,046 S * 12/2001 Borcherds et al. ..... D28/63
6,425,159 B1 * 7/2002 Chen ..... 15/118

* cited by examiner

MESH SPONGE WITH LOOFAH

This application claims priority to U.S. Provisional Application No. 60/137,660, filed Jun. 4, 1999 and is a continuation-in-part of U.S. Design patent application Ser. No. 29/108,962, filed Aug. 6, 1999. For purpose of disclosure, the above applications are hereby incorporated by specific reference.

BACKGROUND OF THE INVENTION

1. The Field of the Invention

The present invention relates to sponge assemblies and, more specifically, mesh sponges having loofah attached thereto.

2. Present State of the Art

Loofah is a natural sponge that is commonly used to exfoliate skin. That is, during a bath or shower, a user will rub the loofah against his or her skin so as to remove the outer layer of the skin. The outer skin layer often includes dry, flaking, or otherwise dead skin. By removing the outer skin layer, softer and more supple skin is exposed.

Although loofah is used extensively, it has various shortcoming. For example, loofah is relatively rigid and vary porous. As such, loofah does not function well for holding soap or creating a lather. It is often preferred to use loofah with a soap lather so as to better clean the body and to help remove the outer skin layer. Furthermore, loofah has a matrix of small interconnected strands wherein the strands are relatively fragile. As such, it is difficult to secure loofah to other desired structures.

BRIEF SUMMARY OF THE INVENTION

The present invention relates to sponge assemblies and corresponding methods of manufacture wherein the sponges assemblies include a substantially spherical mesh sponge having natural loofah in some form attached thereto. In one embodiment, the loofah element comprises a substantially flat disk. The disk includes an inner layer of compressed loofah, and outer layer of compressed loofah, and a reinforcing layer disposed therebetween. An attachment loop is stitched to the inner layer of loofah such that the stitching passes through the reinforcing layer. The reinforcing layer helps to prevent the stitching from pulling out of the loofah. Surrounding the perimeter edge of the inner and outer loofah layers is an edging. The edging holds together and covers the abrasive edges of the compressed loofah layers.

The mesh sponge is formed by radially stretching a tube of the mesh sponge over a pair of spaced apart supports. The netted tube is gathered into a band. A cord is passed around opposing center portions of the band and through the attachment loop of the disk. The band is then tightened such that the opposing center portions of the band are secured together. In this configuration, the ends of the loofah adjacent to the supports are selectively plucked off of the supports. More specifically, incremental portions of the band are stretched off of the adjacent supports and then released causing the portions to rebound. The plucking or stretched withdraw of incremental portions of the band is continued until the entire band is removed from the supports. The plucking is accomplished such that the removed band is formed into a substantially spherical mesh sponge having the flat loofah disk attached thereto.

In an alternative embodiment, the loofah element comprises a block of uncompressed natural loofah. In one design, an attachment loop is directly secured to the side of the block of loofah. Alternatively, a passageway is formed extending into and out of the block. In each embodiment, the cord which is passed around the central portion of the mesh band, as discussed above, is passed through the attachment loop or through the passageway in the block of loofah. Once the cord is tightened, the mesh band is plucked from the supports as discussed above. The mesh band is thus formed into a substantially spherical mesh sponge having the block of loofah attached to the side thereof.

The resulting combination of the netted sponge and loofah element produces a unique and beneficial product. Specifically, the mess sponge is effective in creating and holding lather while the loofah is effective in removing the outer skin layer. The combination produces synergistic properties for improved skin exfoliation. The invention is also unique in the configuration of the different loofah elements and how they are attached to the mesh sponge. Likewise, the method in which the mesh sponge and loofah elements are made and secured together is unique.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
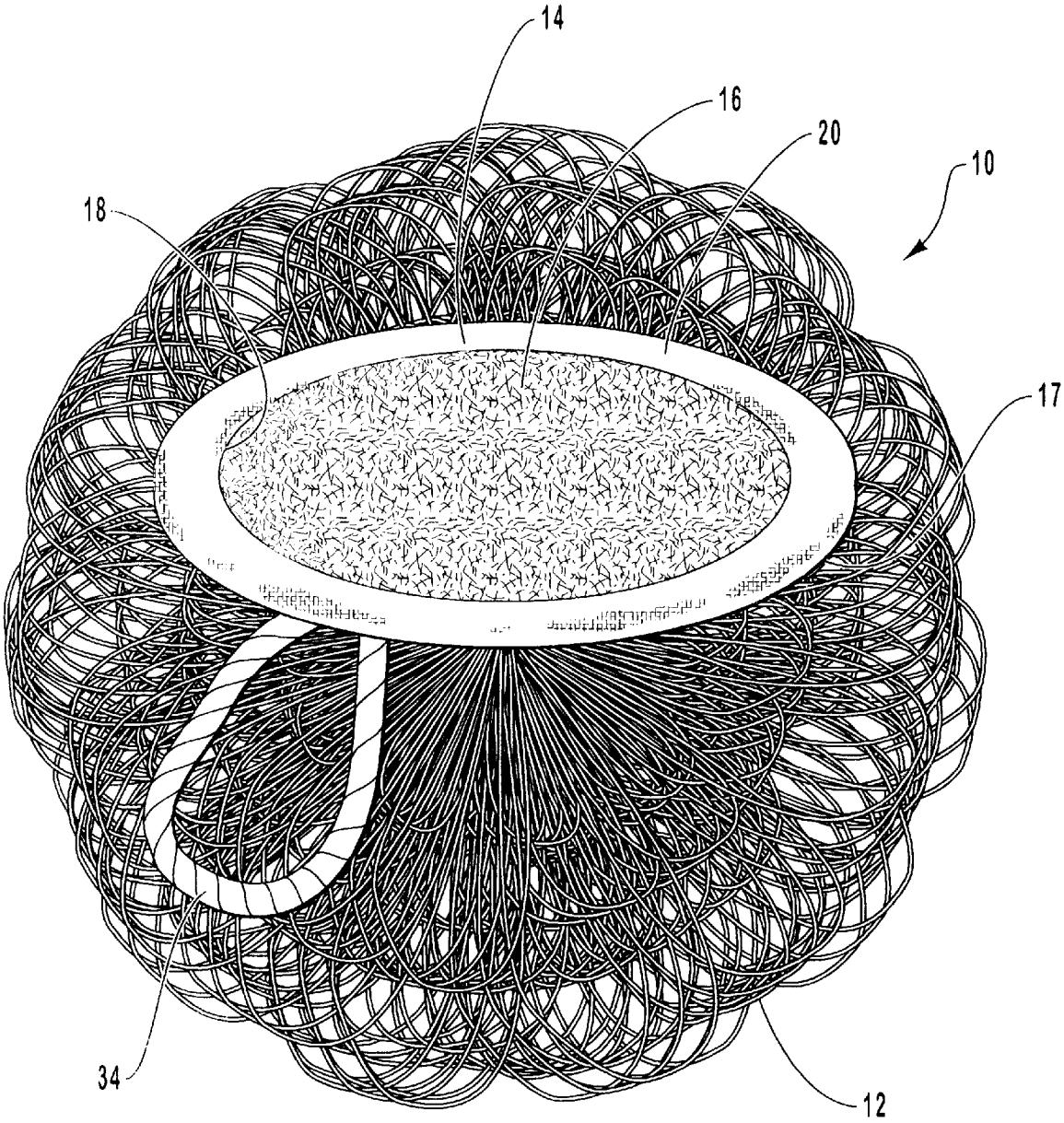
FIG. 1 is a perspective view of a mesh sponge having a flat disk of compressed loofah attached thereto.
Figure 2A:
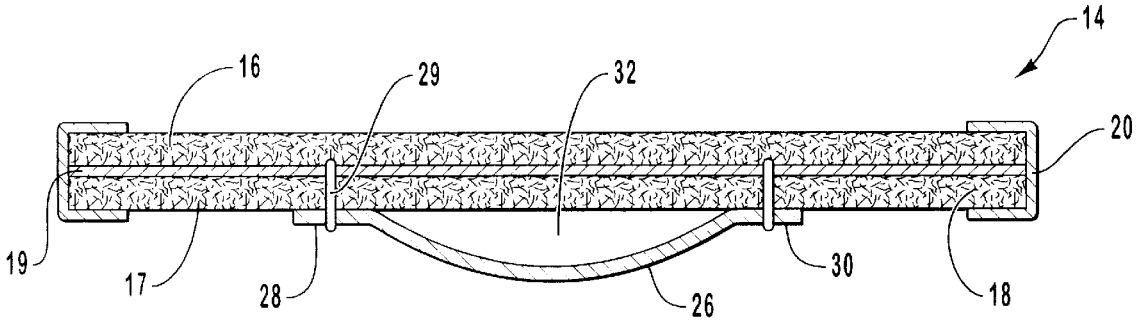
FIG. 2A is a cross sectional side view of the flat disk shown in FIG. 1.

Depicted in FIG. 1 is one embodiment of an inventive sponge assembly 10 incorporating features of the present invention. As depicted therein, sponge assembly 10 includes a substantially spherical mesh sponge 12 having a loofah disk 14 secured thereto by a cord loop 34. As depicted in FIGS. 1 and 2A, disk 14 comprises a compressed outer layer 16 of loofah and a compressed inner layer 17 of loofah. Each layer 16 and 17 extends to a perimeter edge 18. Positioned between layers 16 and 17 is a reinforcing layer 19. Reinforcing layer 19 can be comprised of a variety of different materials such as plastic, leather, ribbon, cloth, or an additional layer of loofah. In one embodiment, reinforcing layer 19 is made of a terry cloth material. Although layers 16 and 17 are depicted as being circular, in alternative embodiments, layers 16 and 17 and resulting disk 14 can be square, triangular, polygonal, or any other desired configuration. Furthermore, reinforcing layer 19 need not be the same size or configuration as layers 16 and 17.

Secured to perimeter edge 18 of layers 16 and 17 is an edging 20. Edging 20 covers the rough cut edges of layers 16 and 17 and prevents layers 16 and 17 from falling apart at perimeter edge 18. Edging 20 can be made of the same materials as reinforcing layer 19 and in one embodiment is comprised of a terry cloth material. Edging 20 is secured by stitching through layers 16, 17 and 19. Stitching through reinforcing layer 19 helps to prevent the stitching from tearing through perimeter edge 18 of layers 16 and 17. In alternative embodiment, edging 20 need not be secured to reinforcing layer 19 and can be secured in a variety of different methods such as crimp fitting, adhesive, or any other conventional means.

Figure 3:
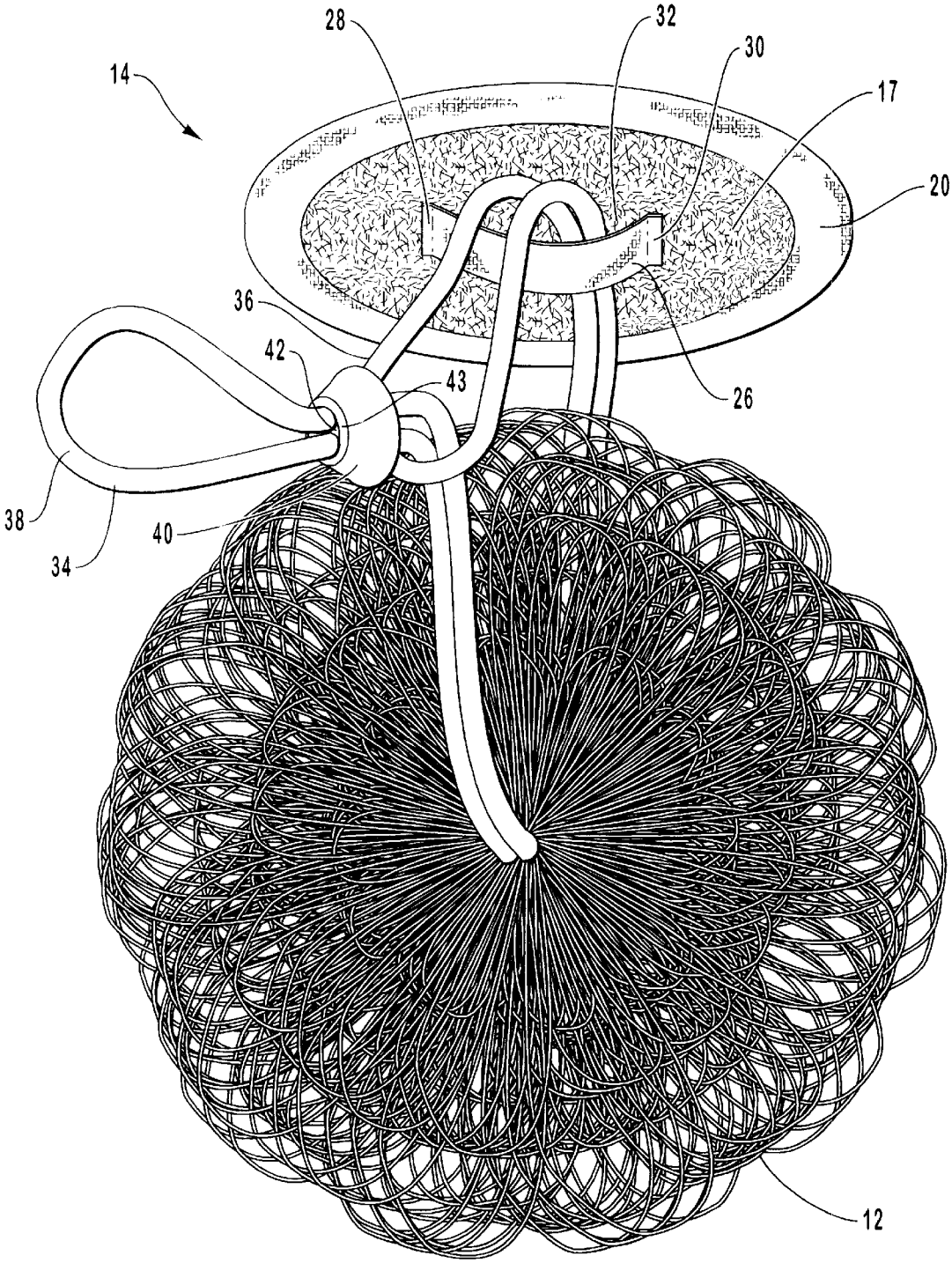
FIG. 3 is a perspective view of the assembly shown in FIG. 1 in a partially disassembled condition.

Depicted in FIGS. 2A and 3, stitching 29 is used to secure opposing ends 28 and 30 of an attachment loop 26 to inner layer 17 and reinforcing layer 19. Reinforcing layer 19 helps to prevent stitching 29 from tearing through layer 17. Attachment loop 26 forms an enclosed passageway 32 that extends between attachment loop 26 and inner layer 17. Attachment loop 26 can be formed from a variety of different materials. For example, attachment loop 26 can be formed from an elastomeric material such as a rubberized strap or from flexible but non-elastic materials such as leather, plastic, ribbon, or cloth. In one embodiment, attachment loop 26 is formed from gross grain ribbon. Attachment loop 26 can also be secured by an adhesive, rivets, or other conventional methods for securing.

Accordingly, in one method for manufacturing disk 14, loop 26 is first stitched to inner layer 17 and reinforcing layer 19. Outer layer 16 in then laid over the opposing side of reinforcing layer 19. Finally, edging 20 is secured.

Figure 2B:
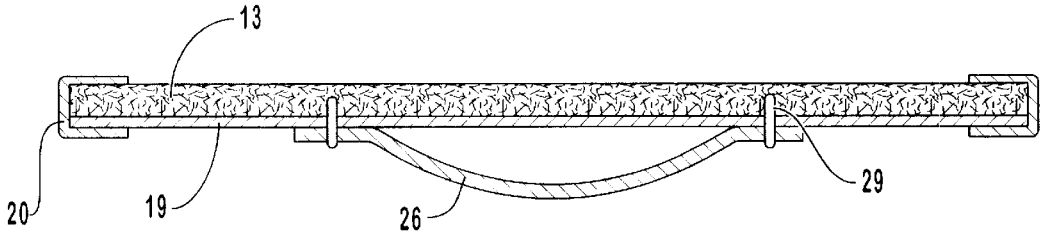
FIG. 2B is a cross sectional side view of an alternative to the flat disk shown in FIG. 1.

The present invention also envisions that disk 14 can be made without the use of reinforcing layer 19. In yet another embodiment, dual layers 16 and 17 can be replaced with a single layer 13 of compressed loofah. In the single loofah layer embodiment, as depicted in FIG. 2B, reinforcing layer 19 can, if desired, be secured to loofah layer 13 by adhesive, stitching, or other conventional means. Attachment loop 26 can then be secured to reinforcing layer 19.

One embodiment of the materials and methods for manufacturing mesh sponge 12 along with methods for attaching cord loop 34 thereto is disclosed in U.S. Pat. No. 5,946,780 entitled Manufacture of Bath Ruffles or Sponges by Cedric M. Borcherds et al. which for purposes of disclosure is incorporated herein by specific reference. Another method for the manufacture of mesh sponge 12 is disclosed in U.S. Pat. No. 5,709,434 which is also incorporated herein by specific reference.

Figure 4:
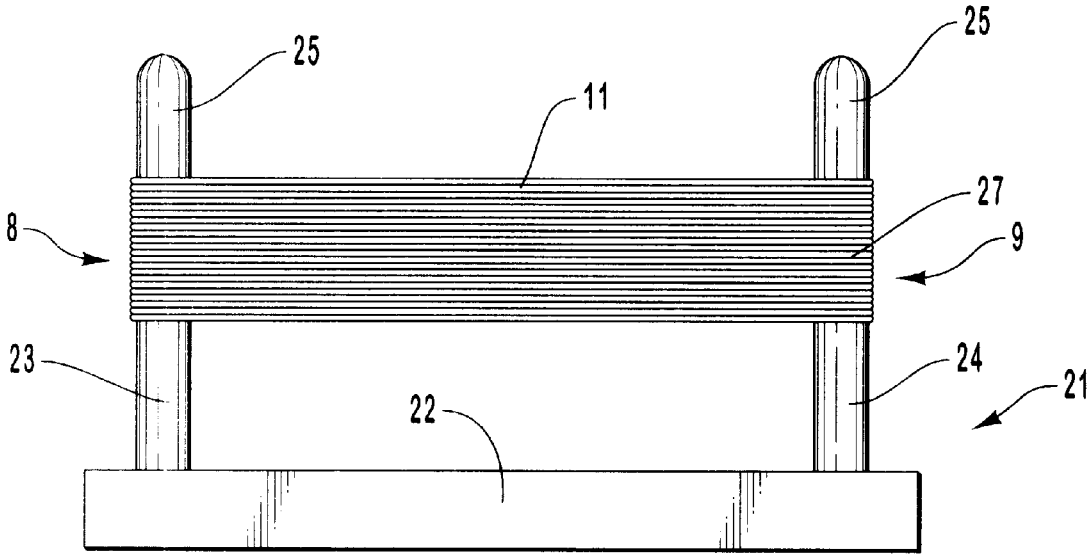
FIG. 4 is an elevated front view of a manufacturing assembly having a band of mesh tubing extending between upright supports, the mesh tubing being used to form the sponge as shown in FIG. 1.

In general terms, disk 14 is secured to mesh sponge 12 by passing cord loop 34 through attachment loop 26 at the same time that cord loop 34 is secured around the mesh netting of mesh sponge 12. More specifically, depicted in FIG. 4 is a manufacturing apparatus 21 comprising a base 22 having a pair of spaced apart supports 23 and 24 upwardly projecting therefrom. Each support 23 and 24 terminates a free end 25 that is typically rounded. Supports 23 and 24 can be any desired configuration and need only have a small slot or space formed therebetween. Furthermore, supports 23 and 24 can be secured in their spaced apart configuration by being mounted or secured in any desired manner.

Figure 6:
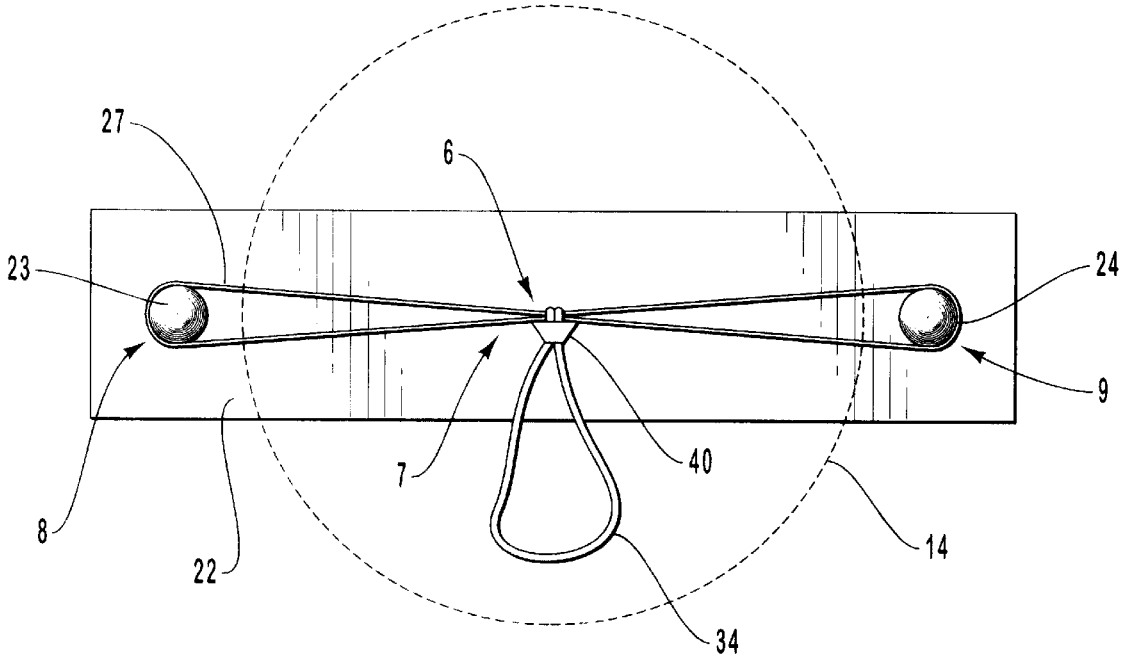
FIG. 6 is a top view of the assembly shown in FIG. 5 with the cord being secured around the band for formation of the substantially spherical sponge.

Sponge 12 is typically made from mesh tubing. One example is low density polyethylene diamond mesh that is extruded in the form of an elongated tube. This mesh is substantially the same as that commonly used in fruit and vegetable bags. It is appreciated that the material used in depicting sponge 12 in the Figures is merely illustrative and due to the difficulty in drawing may not be a precise depiction of diamond mesh netting. As also depicted in FIG. 4, during manufacture a length of tubular mesh 11, typically having a length in a range between about 3 yards to about 5 yards, is radially outwardly stretched and received over free end 25 of spaced apart supports 23 and 24. Tubular mesh 11 is longitudinally compress or gathered to form a band 27 that continuously encircles supports 23 and 24. As depicted in FIGS. 4 and 6, band 27 has a pair of opposing central portions 6 and 7 that are centrally disposed between supports 23 and 24. Band 27 also has a pair of opposing end portions 8 and 9 that are generally located at or adjacent to supports 23 and 24.

Figure 5:
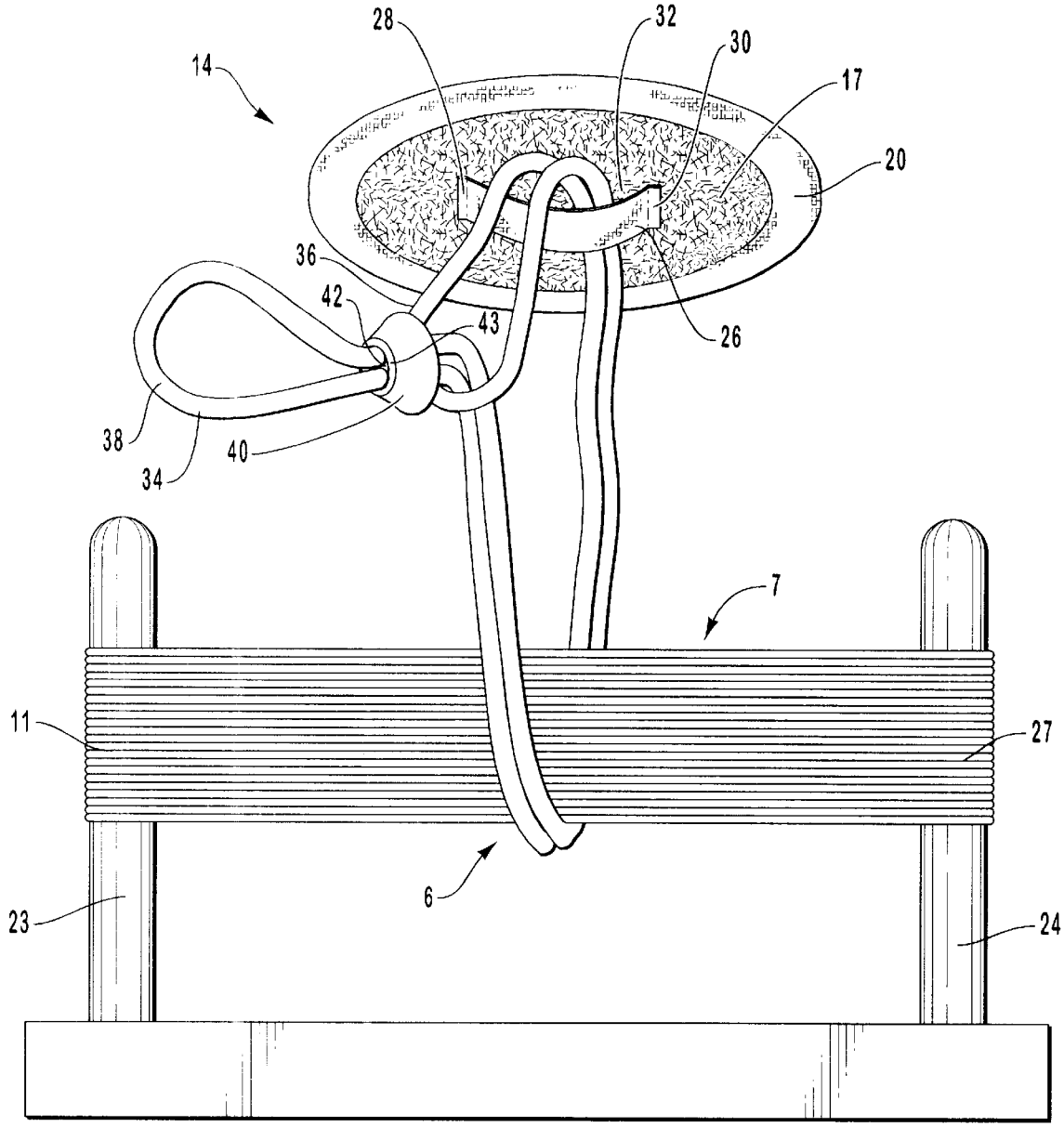
FIG. 5 is a perspective view of the manufacturing assembly shown in FIG. 4 having the flat loofah of FIG. 1 attached to the mesh band by a cord.

As depicted in FIG. 5, cord loop 34 has a first end 36 and an opposing second end 38. During assembly, first end 36 of cord loop 34 is passed around central portions 6 and 7 of band 27 and through passageway 32 bounded by attachment loop 26. First end 36 of cord loop 34 is then passed over second end 38 of cord loop 34 so as to form a cow hitch that connects disk 14 and band 27 together. As the cow hitch is tightened, a fastener 40 is slid over second end 38 of cord 34 so as to bias against first end 36, thereby securing the cow hitch in the tightened positioned.

In the embodiment depicted, fastener 40 has a frustoconical body that terminates at an annular mouth 43. Mouth 43 bounds an aperture 42 through which cord loop 34 is passed. Aperture 42 is slightly smaller than cord loop 34 which is passed therethrough. As a result, mouth 43 compresses cord loop 34 as it is pulled therethrough and biases against cord loop 34 so as to prevent cord loop 34 from sliding back through aperture 42. Fastener 40 and alternatives thereof are further disclosed in U.S. Pat. No. 5,946,780 which was previously incorporated herein by specific reference and U.S. Pat. No. 5,766,700 entitled Loop Fastening Device by Cedric M. Borcherds which is incorporated herein by specific reference.

Once cord loop 34 is at least partially tightened around mesh band 27 as depicted in FIG. 6, band 27 is incrementally released from supports 23 and 24. Specifically, select portions of end portions 8 and 9 of band 27 are drawn off of corresponding support 23 and 24 and outwardly stretched. The stretched portions are then released and allowed to rebound off of supports 23 and 24. This plucking action of drawings, stretching, and releasing incremental portions of end portions 8 and 9 is repeated until the entire mesh band 27 is removed from supports 23 and 24. As a result, band 27 is formed into a substantially spherical mesh sponge 12.

To obtain sponge 12 having the substantially spherical configuration, the select portions of end portions 8 and 9 can be stretched off of supports 23 and 24 at virtually any 360° angle relative to supports 23 and 24. Furthermore, the select portions of end portions 8 and 9 can be drawn off in the same or opposing directions and can be drawn off at the same or different times. The orientation in which the select portions of end portions 8 and 9 are drawn off and stretch can also vary during the release of band 27.

Once band 27 is completely released from supports 23 and 24 so as to be in the substantially spherical configuration, the cow hitch or cord loop 34 can be further tightened, if needed, so as to tightly secure disk 14 to sponge 12.

The present invention includes means for connecting mesh sponge 12 and disk 14 of compressed loofah together. On example of such means is cord loop 34 with fastener 40 as discussed above. In alternative embodiments of the means, there are of course a variety of ways to secure disk 14 and mesh sponge 12 together. For example, in contrast to using cord loop 34 a tie can be used to secure disk 14 and mesh sponge 12 together. As used in the specification and appended claims, the term "tie" is broadly intended to include conventional cord, string, ribbon, twine, thread, line such as plastic line, rope, webbing, straps, and the like which can linear, looped, or in any other desired configuration. In another embodiment, in contrast to using fastener 40, cord loop 34 or a tie can simply be knotted. In another embodiment, a first tie can be used to secure sponge 12 and disk 14 together. A second tie can then be attached to disk 14 and/or sponge 12 and/or the first tie to provide a handle for the resulting combination. In Still another embodiment, a first tie can be used to first independently secure together opposing central portions 6 and 7 of band 27 to enable formation of spherical sponge 12 as discussed above. A second tie can then be used to secure sponge 12 and disk 14 together such as depicted in FIG. 3.

Figure 7:
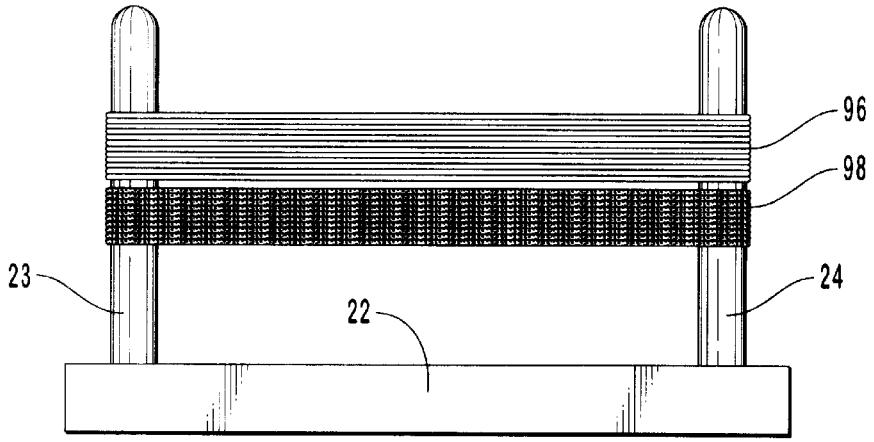
FIG. 7 is an elevated front view of the assembly shown in FIG. 4 having a first band of mesh and a second band of mesh vertically disposed there below.
Figure 8:
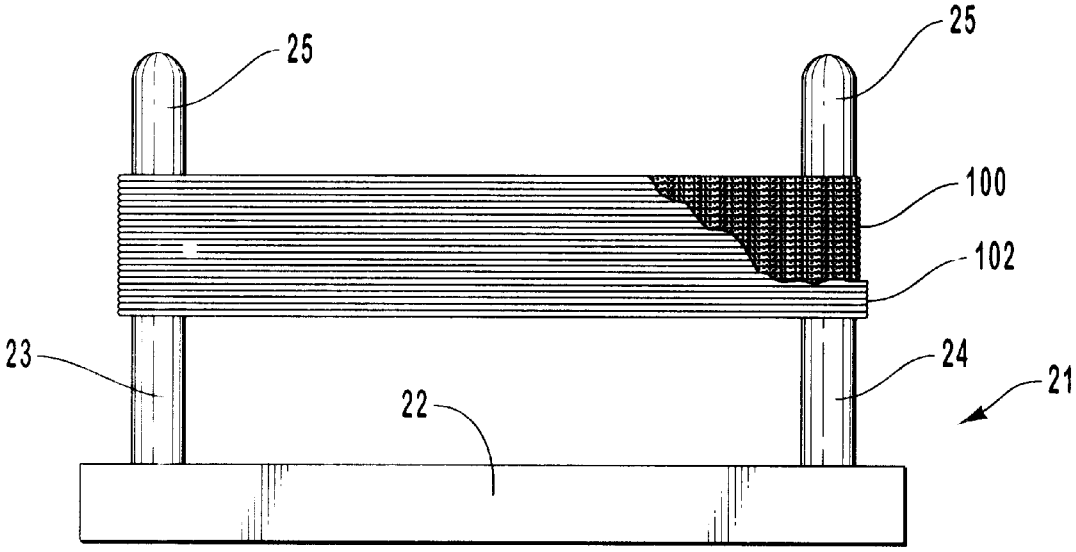
FIG. 8 is an elevated front view of the assembly shown in FIG. 4 having a first band of mesh being concentrically encircled by a second band of mesh.

In yet other alternative embodiments of the present invention, it is envisioned that as opposed to using a single length of mesh tubing to form sponge 12, a plurality of discrete lengths of mesh tubing can be used. For example, depicted in FIG. 7 a first mesh tubing 96 is vertically disposed above a second mesh tubing 98. In FIG. 8, a first mesh tubing 100 is concentrically disposed within a second mesh tubing 102. The different mesh tubings can have different colors, textures, composition, mesh sizes and other alternative properties to further enhance the look and functionality of the resulting sponge. Such alternative materials and the functionality for using them in the above configurations are further discussed in U.S. Pat. No. 5,946,780 which was previously incorporated herein by specific reference. It is also appreciated that a single mesh tube can have two or more sections each having a different color.

Figure 9:
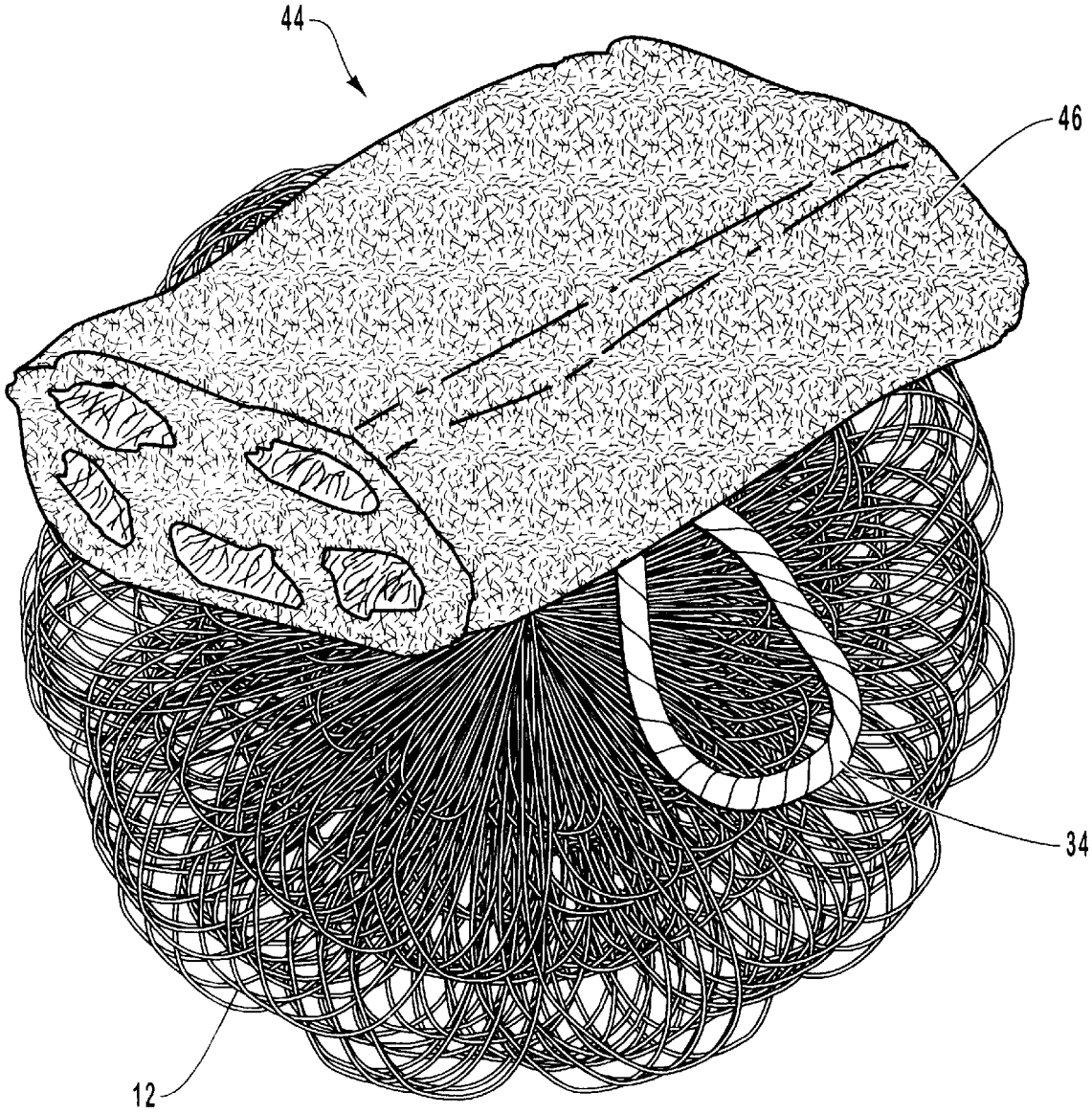
FIG. 9 is a perspective view of a block of natural loofah secured to a mesh sponge.
Figure 10:
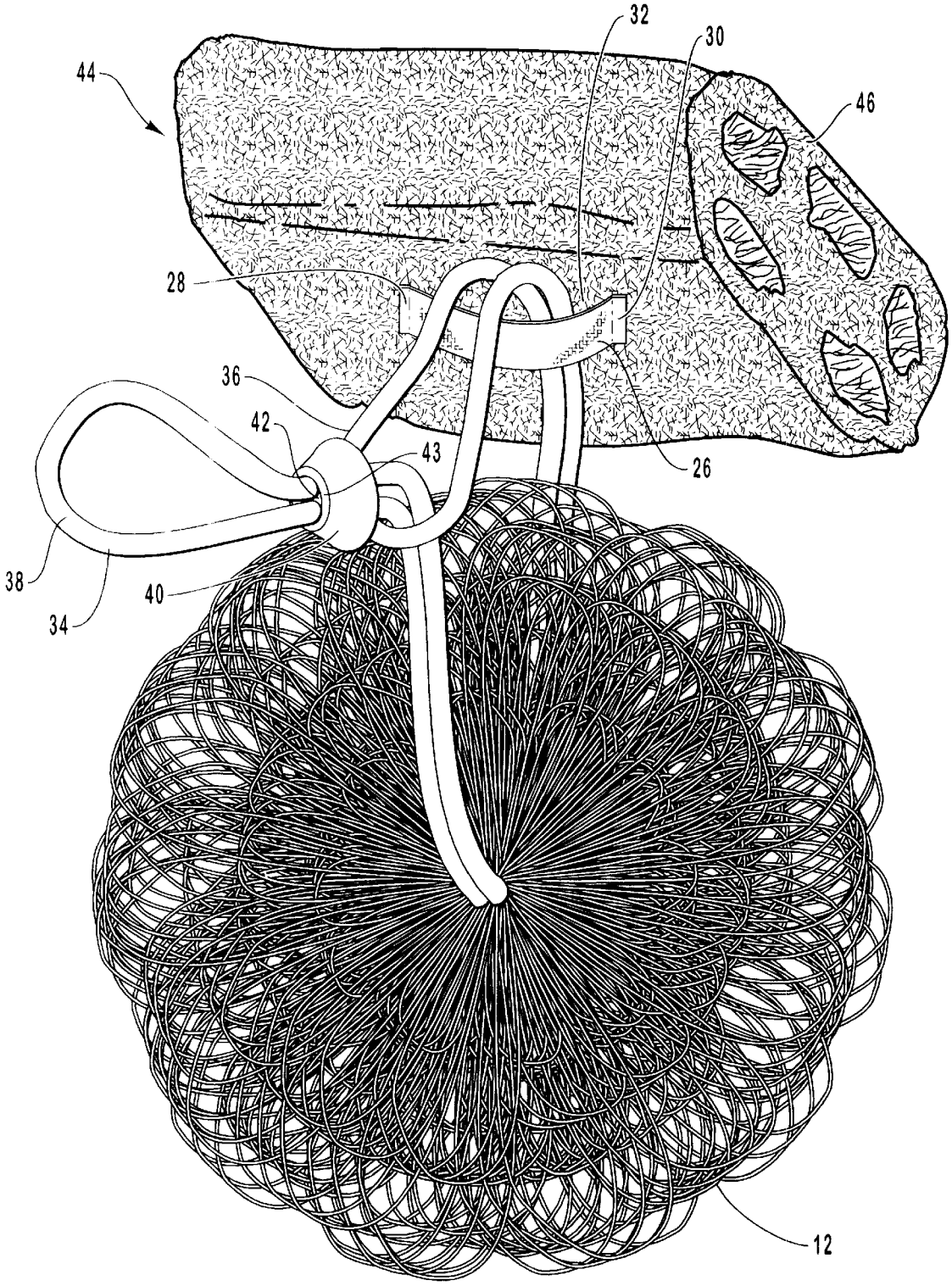
FIG. 10 is a perspective view of the sponge assembly shown in FIG. 9 having an attachment loop mounted to the block of loofah.

Depicted in FIG. 9 is an alternative sponge assembly 44. Sponge assembly 44 comprises mesh sponge 12, cord loop 34, and a block 46 of natural loofah. In contrast to layers 16 and 17 of the embodiment depicted in FIG. 1, block 46 of loofah has not been compressed. As depicted in FIG. 10, block 46 can be secured to mesh sponge 12 by securing an attachment loop 26 thereto. Attachment loop 26 can be directly secured to block 40 by stitching, adhesive, or any other conventional method.

Figure 11:
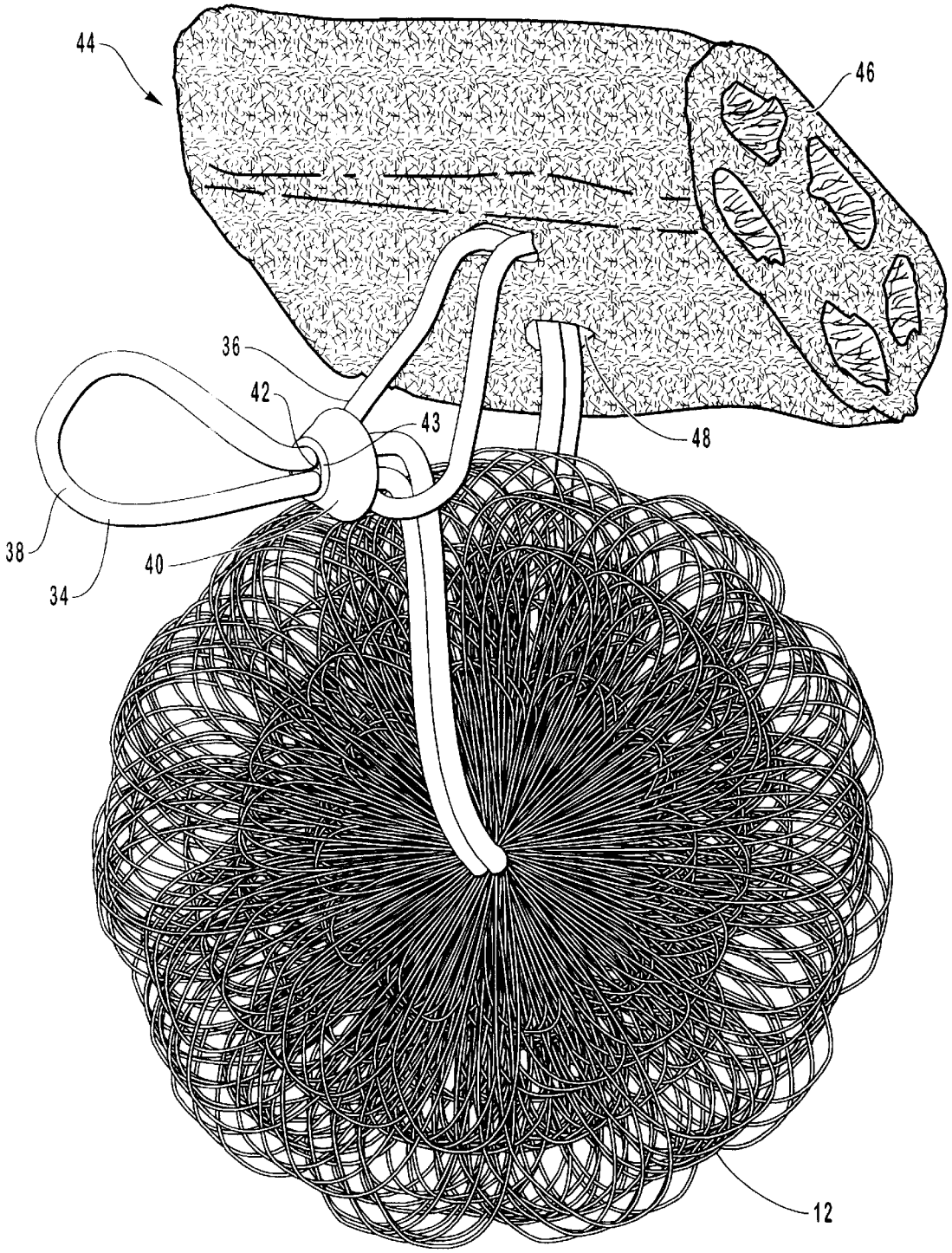
FIG. 11 is a perspective view of the sponge assembly shown in FIG. 9 having a channel formed within the block of loofah for receiving the cord.

In an alternative embodiment as depicted in FIG. 11, a channel 48 can be formed extending into and out of block 46. Channel 48 is configured to enable cord loop 34 or a tie to pass therethrough, thereby directly securing block 46 to mesh sponge 12. Block 46 can also be secured by an adhesive or by other types of fasteners as previously discussed or known to those skilled in the art.

In any of the above embodiments, sponge 12 can be formed and secured to block 46 in the same manner as discussed above with regard to the embodiment of FIG. 1 and the alternatives thereof.

Figure 12:
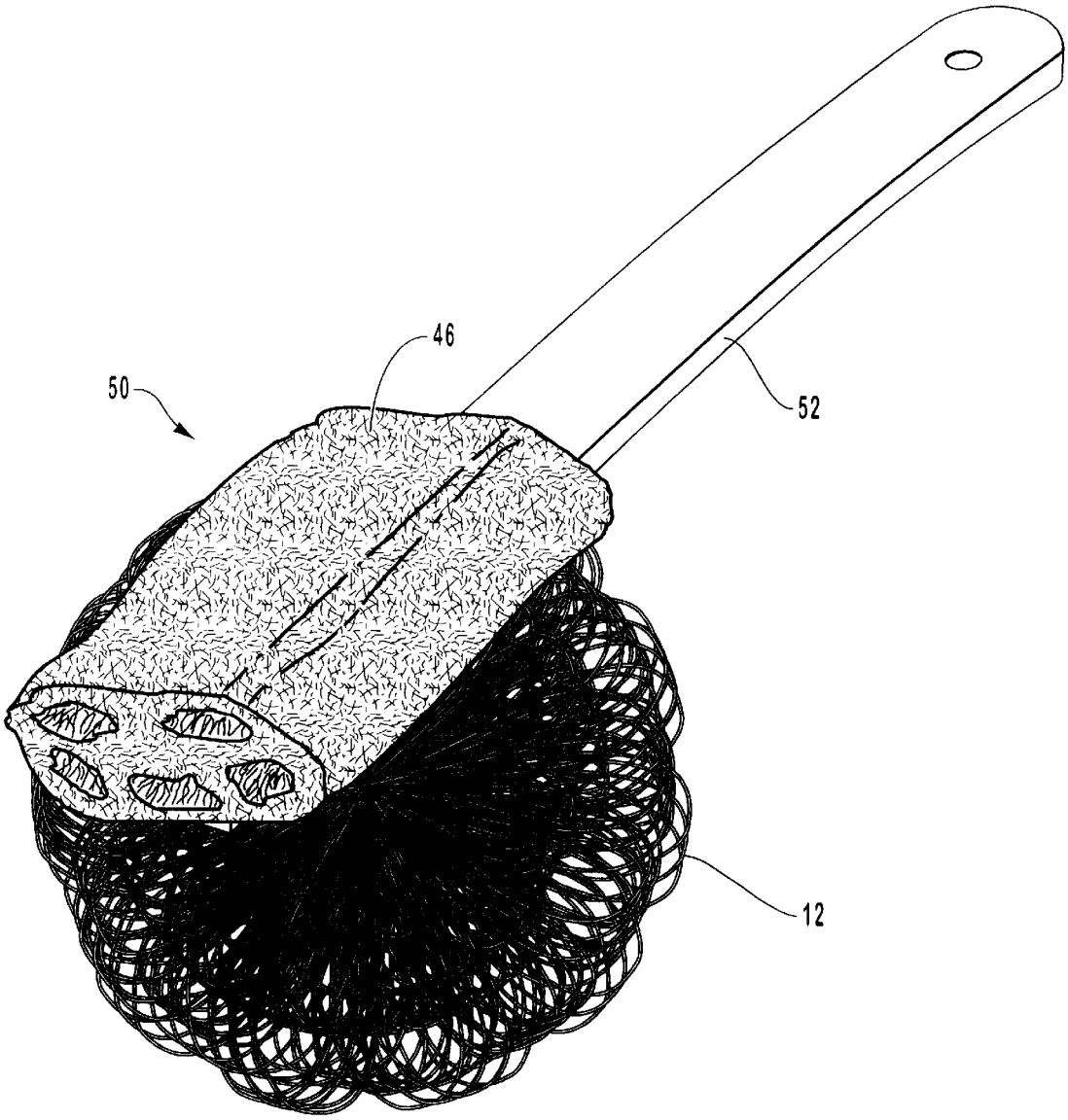
FIG. 12 is a perspective view of a mesh sponge and a block of natural loofah each secured to a rod.
Figure 13:
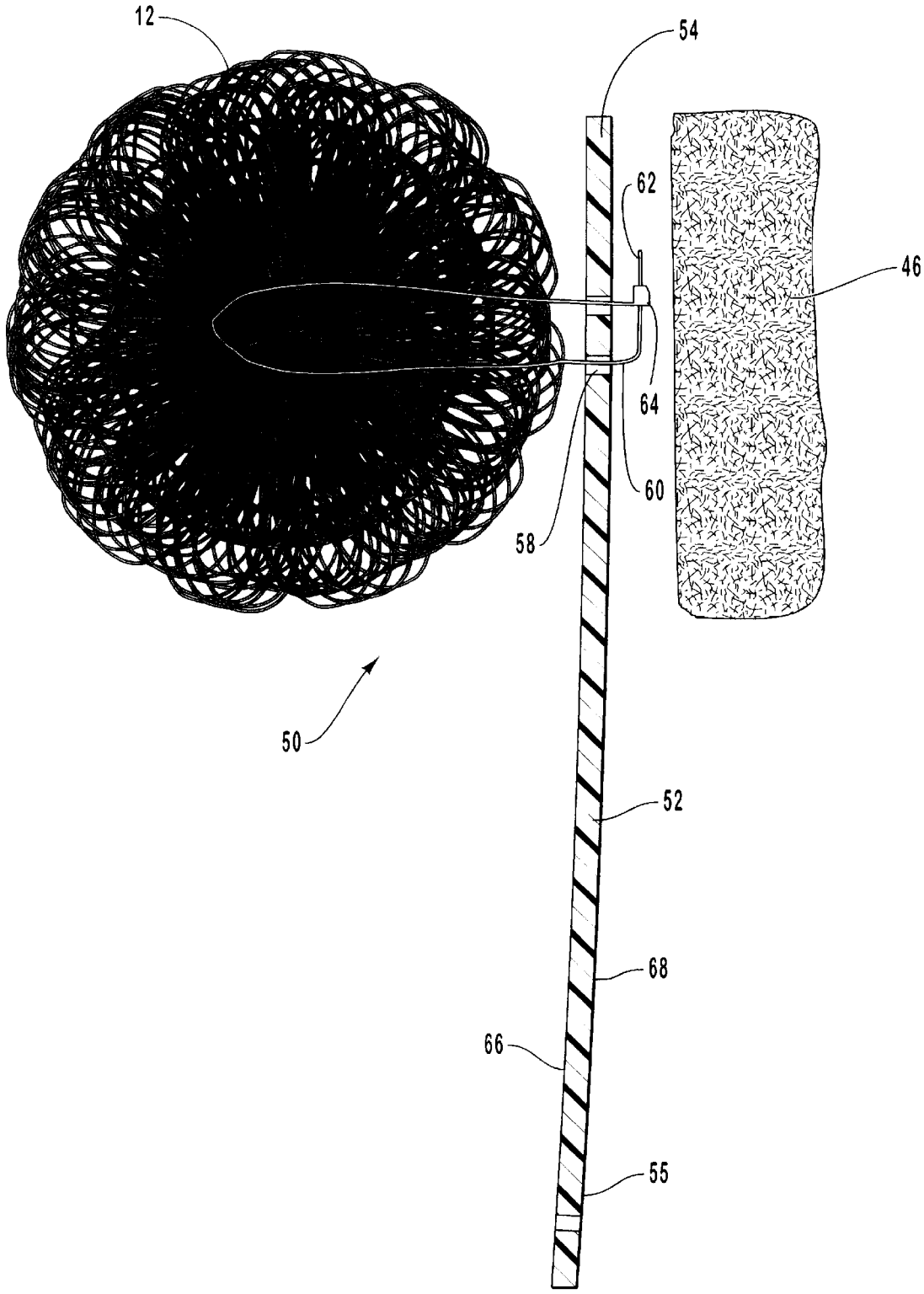
FIG. 13 is a partial cross-sectional side view of the assembly shown in FIG. 4 in a disassembled condition.

Depicted in FIG. 12 is another alternative sponge assembly 50. Sponge assembly 50 includes mesh sponge 12 and block 46 each secured to the end of an elongated rod 52. Sponge assembly 50 can be used for scrubbing a user's back and other hard to reach places. As depicted in FIG. 13, rod 52 has a front face 66 and an opposing back face 68 each extending between a top end 54 and an opposing bottom end 55. A pair of spaced apart apertures 56 and 58 extend through top end 54 of rod 52. A conventional self-locking tie 60 is passed through each of apertures 56 and 58 so as to loop around mesh sponge 12. A free end 64 of tie 60 is then passed through a locking head 64 and pulled tight, thereby snugly securing mesh sponge 12 to front face 66 of rod 52.

Block 46 can be secured to rod 52 in a variety of different ways. For example, block 46 can be secured to back face 68 of rod 52 by an adhesive. Alternatively, tie 60 can be loop through block 46 so as to secure block 46 to rod 52. Rod 52 can also be passed through at least a portion of block 46 to help secure the attachment thereto. The present invention also appreciates that block 46 can be replaced with a compressed layer of loofah or some other configuration of loofah.

Figure 14:
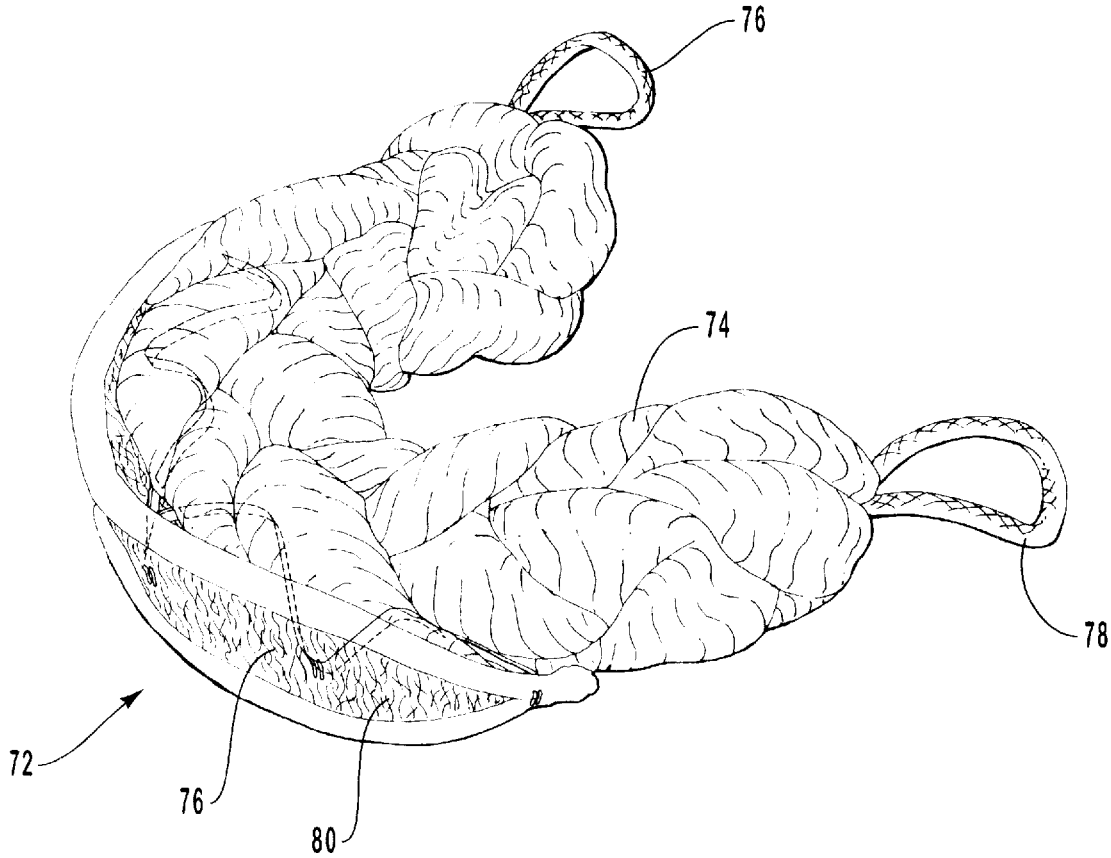
FIG. 14 is a perspective view of a braided mesh sponge having a strip of compressed loofah secured thereto.
Figure 15:
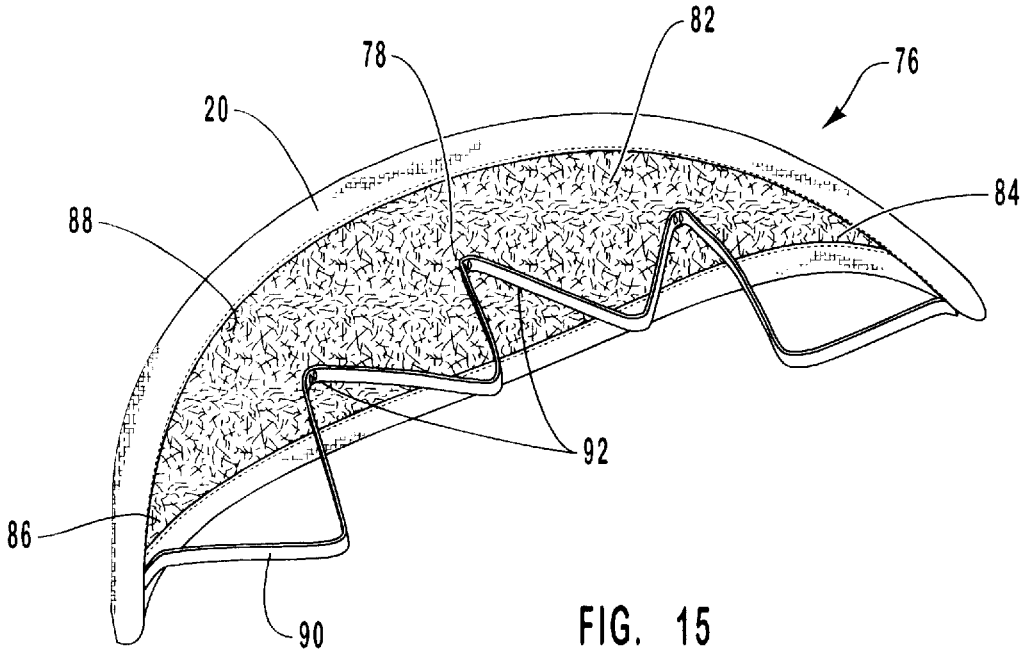
FIG. 15 is a perspective view of the strip of compressed loofah depicted in FIG. 6.

Depicted in FIG. 14 is another embodiment of a sponge assembly 72. Sponge assembly 72 includes an elongated braided mesh sponge 74 having cords 76 and 78 mounted on opposing ends thereof. In one embodiment, braided mesh sponge 74 comprises discrete loops of mesh material that are coupled together. The resulting sponge 74 is elastomeric and is useful in rubbing across the back of a user. Secured along the length of sponge 74 is an elongate loofah strip 76. As depicted in FIG. 15, loofah strip 76 comprises a layer 78 of compressed loofah. Layer 78 has a front face 80 and an inside face 82 each extending between opposing tapered ends 84 and 86. Secured along a perimeter edge 88 of layer 78 is edging 20 as previously discussed. It is appreciated that strip 76 can comprise the same multiple layers, including reinforcing layer 19, as previously discussed with regard to disk 14.

Extending between opposing ends 84 and 86 along inside face 82 of layer 78 is an elastic strap 90. Elastic strap 90 is also stitched or otherwise secured at spaced apart locations 92 along the length of layer 78. Strap 90 is used to secure loofah strip 76 to sponge 74 by looping strap 90 through the braids or loops of sponge 74.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A sponge assembly comprising:

(a) a substantially spherical mesh sponge;

(b) a substantially flat disk of compressed loofah; and (c) means for connecting the mesh sponge and the disk of compressed loofah together.

2. A sponge assembly as recited in claim 1, wherein the flat disk of compressed loofah has an attachment loop secured to a side thereof.

3. A sponge assembly as recited in claim 2, wherein the means for connecting comprises a tie passing around the mesh sponge and through the attachment loop.

4. A sponge assembly as recited in claim 1, wherein disk of compressed loofah has a perimeter edge, the perimeter edge being covered by an edging.

5. A sponge assembly as recited in claim 1, wherein the flat disk of compressed loofah comprises:

(a) a layer of compressed loofah; and (b) a layer of reinforcing material.

6. A sponge assembly as recited in claim 1, wherein the mesh sponge comprises a first and second piece of tubular mesh material, the first piece of mesh material being at least partially disposed within the second piece of mesh material.

7. A sponge assembly comprising:

(a) a substantially spherical mesh sponge;

(b) a substantially flat disk including:

(i) an outer layer of compressed loofah;

(ii) an inner layer of compressed loofah; and (iii) a reinforcing layer disposed between the inner layer and the outer layer; and (c) a tie connecting the mesh sponge and the disk together.

8. A sponge assembly as recited in claim 7, further comprising an attachment loop stitched to the reinforcing layer, the tie passing through the attachment loop.

9. A sponge assembly as recited in claim 7, wherein the outer layer and the inner layer of compressed loofah each have a perimeter edge, at least a portion of each perimeter edge being covered by an edging.

10. A sponge assembly as recited in claim 9, wherein the edging is stitched through the reinforcing layer.

11. A sponge assembly as recited in claim 7, further comprising a fastener mounted on the tie, the fastener keeping the tie tightly secured to the substantially spherical sponge and flat disk.

* * * * *

UNITED STATES PATENT AND TRADEMARK OFFICE

CERTIFICATE OF CORRECTION

PATENT NO. : 6,510,577 B1 
DATED : January 28, 2003
INVENTOR(S) : Victor Borcherds, Suzanne Borcherds and Manfredo Nolasco It is certified that error appears in the above-identified patent and that said Letters Patent is hereby corrected as shown below:

Column 1,
Lines 23-24, change “shortcoming” to -- shortcomings --
Line 36, change “sponges” to -- sponge --
Line 41, before “outer” change “and” to -- an --
Line 60, change “withdraw” to -- withdrawal --

Column 3,
Line 64, change “in” to -- is --

Column 4,
Line 40, change “compress” to -- compressed --

Column 5,
Line 22, change “stretch” to -- stretched --
Line 46, change “Still” to -- still --
Line 60, change “composition” to -- compositions --

Column 6,
Line 37, change “loop” to -- looped --

Column 7,
Line 20, before “disk” insert -- the --

Signed and Sealed this

First Day of April, 2003

JAMES E. ROGAN
*Director of the United States Patent and Trademark Office*